US009549592B2

(12) United States Patent
Quagliotto et al.

(10) Patent No.: US 9,549,592 B2
(45) Date of Patent: Jan. 24, 2017

(54) TIGHTENING DEVICE FOR FOOTWEAR AND FOOTWEAR PROVIDED WITH SUCH TIGHTENING DEVICE

(71) Applicant: Tecnica Group S.P.A., Giavera del Montello (TV) (IT)

(72) Inventors: Silvio Quagliotto, Giavera del Montello (IT); Claudio Zampieri, Giavera del Montello (IT)

(73) Assignee: Tecnica Group S.P.A., Giavera del Montello, Treviso (IT)

( * ) Notice: Subject to any disclaimer, the term of this patent is extended or adjusted under 35 U.S.C. 154(b) by 0 days.

(21) Appl. No.: 14/676,970

(22) Filed: Apr. 2, 2015

(65) Prior Publication Data

US 2015/0289593 A1 Oct. 15, 2015

(30) Foreign Application Priority Data

Apr. 10, 2014 (IT) ..... T02014A0310

(51) Int. Cl.
*A43C 11/14* (2006.01)
*A43B 5/04* (2006.01)
(Continued)

(52) U.S. Cl.
CPC ..... *A43C 11/14* (2013.01); *A43B 5/0401* (2013.01); *A43B 5/0409* (2013.01); *A43B 5/16* (2013.01); *A43C 11/12* (2013.01)

(58) Field of Classification Search
CPC ..... A43C 11/14; A43C 11/12; A43C 11/1493; A43C 11/1406; A43C 11/1413; A43C 11/142; A43C 11/1426; A43C 11/1433; A43C 11/144; A43C 11/1446; A43C 11/453; A43C 11/146; A43C 11/1466;A43C 11/1473; A43B 5/0401; A43B 5/16; A43B 5/1625; A43B 5/04; A43B 5/0429; A43B 5/0433; A43B 5/0482
(Continued)

(56) References Cited

U.S. PATENT DOCUMENTS 6,026,594 A 2/2000 Fougere
6,305,054 B1 * 10/2001 Imes ..... F01N 13/1805 24/276
(Continued)

FOREIGN PATENT DOCUMENTS

FR 2876883 A1 * 4/2006 ..... A43B 5/04

OTHER PUBLICATIONS

Chiange, Jerome and Danezin, Jean Bruno, Google English Translation of FR2876883, published Oct. 22, 2004, translated Aug. 19, 2015.*
(Continued)

*Primary Examiner* — Anna Kinsaul
*Assistant Examiner* — Heather Mangine
(74) *Attorney, Agent, or Firm* — Howson & Howson, LLP

(57) ABSTRACT

A tightening device is provided for footwear, in particular, for sports footwear of the kind comprising a substantially rigid outer element and a substantially flexible inner element. The tightening device comprises a strap element and the strap element is configured so that—when it is tensioned—it is capable of applying pressure directly both onto the outer element and to the inner element, whereby the pressure is applied more efficiently and uniformly and the user's comfort is thus increased. In addition, the strap element has a substantially continuous surface, which increase the stability of the tightening device and eliminates
(Continued)

the risk of an incorrect positioning also in the case of high stresses during sports practices.

18 Claims, 2 Drawing Sheets

(51) Int. Cl.
*A43B 5/16* (2006.01)
*A43C 11/12* (2006.01)

(58) Field of Classification Search
USPC ..... 36/115, 117.1, 117.2, 117.7, 50.1, 50.5, 36/117.9, 72 R, 89, 96; 24/70 SK, 70 ST, 24/69 ST, 24/69 SK, 71 SK, 68 SK; 285/407, 408, 409
See application file for complete search history.

(56) References Cited

U.S. PATENT DOCUMENTS

| | | | | |
|---|---|---|---|---|
| 8,359,771 | B2 * | 1/2013 | Holzer | A43B 5/0433 36/115 |
| 2013/0047388 | A1 * | 2/2013 | Kavarsky | A43C 11/1413 24/68 SK |

OTHER PUBLICATIONS

Search Report and Written Opinion issued for counterpart Italian Patent Application No. TO2014A000310 dated Dec. 2014.

* cited by examiner

TIGHTENING DEVICE FOR FOOTWEAR AND FOOTWEAR PROVIDED WITH SUCH TIGHTENING DEVICE

BACKGROUND

The present invention relates to a tightening device for footwear and a footwear provided with such tightening device.

In particular, the present invention relates to a tightening device for a sports footwear of the kind comprising a substantially rigid outer element and a substantially flexible inner element and a sports footwear of the kind comprising a substantially rigid outer element and a substantially flexible inner element provided with such tightening device.

Sports footwear are known comprising a substantially rigid outer element or shell and a substantially flexible inner element or liner which is at least partially housed inside the outer element. Ski boots are a clear example of sports footwear of this kind.

In this kind of sports footwear the inner liner with its upper part usually projects at least in sections from the upper edge of the outer shell.

Still according to the prior art, these sports footwear may include a tightening device provided near the upper end of the outer shell and of the inner liner for tightening the sports footwear around the user's leg. In particular, the tightening device can be made substantially as a ring and can include adjusting means for more or less limiting the width of the ring, so as to more or less tighten the sports footwear around the user's leg.

For example, U.S. Pat. No. 6,026,594 describes a tightening device comprising a strap element arranged for being attached frontally near the upper end of the cuff of a sports footwear (especially of a ski boot) and a pair of bands connected to the opposite ends of the strap element; the two bands can be linked to each other by means of a buckle so as to obtain a ring around the cuff of the sports footwear, and the position of the buckle can be adjusted so as to vary the width of the obtained ring and to tighten the tightening device on the cuff of the sports footwear. During use, with the tightening device being tensioned, the strap element exerts a pressure onto the cuff of the sports footwear surrounding the user's leg.

A disadvantage of this solution lies in the fact that the strap element exerts pressure directly onto the rigid outer shell of the sports footwear and only indirectly—through intermediation of the outer shell—onto the flexible inner liner, which limits the user's comfort.

This disadvantage is particularly detrimental when considering that in sports footwear comprising a rigid outer shell and a flexible inner liner, footwear comfort is provided mainly by the inner liner, whereas the outer shell has mainly the function of conferring structural strength to the footwear and of efficiently conveying forces from the user to the sports item.

A further disadvantage of the solution described above consists in that, in those areas where the inner liner projects from the outer edge of the outer shell, the strap element is not in contact with the footwear surface. Consequently the pressure is not uniformly distributed; rather, there are created discrete pressure points that are detrimental to the user's comfort.

U.S. Pat. No. 8,359,771 describes a solution in which the tightening device includes a strap element comprising a first element and a second element that are mutually separated and vertically superimposed on each other, wherein the upper element is configured and arranged so as so abut against the inner liner of the footwear and the lower element is configured and arranged so as to abut against the outer shell of the footwear. According to what is described, such solution allows on one hand to act directly both onto the outer shell and onto the inner liner and on the other hand to obtain a more uniform distribution of pressure.

However, this solution too is not free from drawbacks. In particular, the fact that the strap element comprises two distinct elements separated by an interposed gap causes poor stability of the tightening element and brings about the risk that the elements may move out of their correct position during use of the footwear.

This risk is particularly evident in the case of sports footwear, where during use the tightening device is exposed to continuous and intense stresses. Especially during sports practices, the small size of the two elements of the strap element and the presence of an open gap between them may cause misalignments, loss of proper adjustment and similar inconveniences.

SUMMARY

The main object of the present invention is to provide a tightening element for footwear, and in particular for sports footwear, that allows to overcome the drawbacks of the prior art by guaranteeing the maximum possible comfort for the user on one hand and ensuring high stability, also in case of high stresses, on the other hand.

These and other objects are achieved with the tightening device for footwear as claimed in the appended claims.

The invention relates to a tightening device intended for a sports footwear and comprising a strap element, the strap element comprising a first section and a second section extending parallel to each other in a first direction and arranged adjacent to each other along a second direction substantially perpendicular to the first direction, wherein the first section lies in a first plane and the second section lies in a second plane offset relative to the first plane in a third direction substantially perpendicular to the first and second directions, and wherein a connecting section is provided for connecting the first and second portions, so that the strap element has a substantially continuous surface.

Preferably, the strap element is made of a material which is elastic while being rigid enough to maintain the aforesaid configuration, with the first and second sections parallel to each other along a first direction, adjacent along a second direction but offset along a third direction. More particularly, the connecting section is rigid enough and designed to keep the first and second sections mutually offset along the third direction, even when the tightening device is subjected to high stresses during sports practices. For instance the strap element is made of injected plastic material.

The invention further relates to a footwear, in particular a sports footwear, comprising a substantially rigid outer element or shell and a substantially flexible inner element or liner, wherein the inner element projects at least in sections from the upper edge of the outer element, the footwear being provided with a tightening device of the kind describe above.

In particular, the strap element of the tightening device is configured so that the first section of the strap element overlaps the outer shell and the second section of the strap element—offset relative to the first section—overlaps the inner liner in those areas where the inner liner projects from the outer shell. Thanks to this configuration, the strap element of the tightening device exerts pressure directly both onto the outer shell and the inner liner. Furthermore, the applied pressure is uniformly distributed, without creating discrete pressure points.

Owing to the fact that—because of the presence of the connecting section—the surface of the strap element is substantially continuous, stability of the tightening device is increased and the risk of incorrect alignment is avoided also in case of high stresses during sports practices.

BRIEF DESCRIPTION OF THE DRAWINGS

Further features and advantages of the invention will become more evident from the ensuing detailed description of a preferred embodiment of the invention itself, given by way of non-limiting example, with reference to the appended drawings, where.

DETAILED DESCRIPTION

Figure 1:
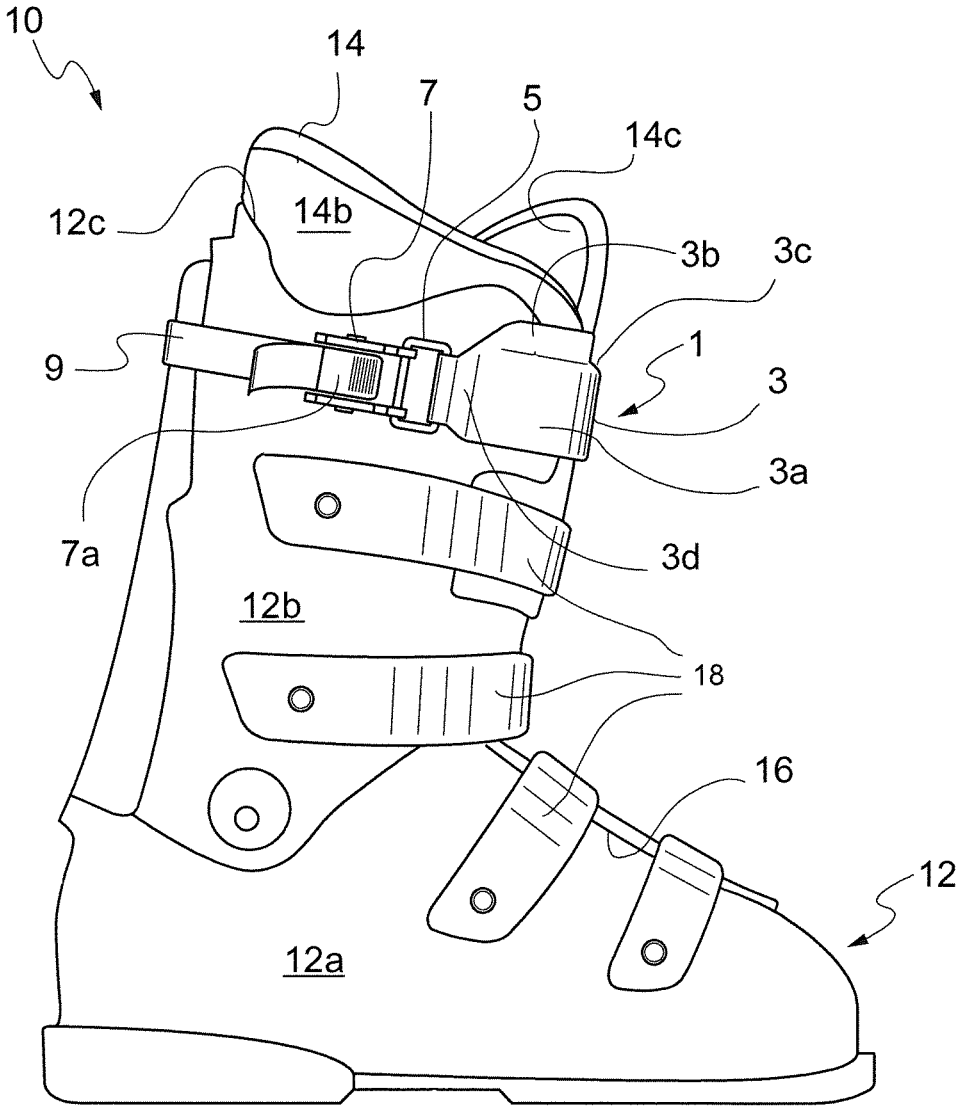
FIG. 1 schematically shows a footwear provided with a tightening device according to the invention.

In FIG. 1, there is illustrated a sports footwear 10 comprising a substantially rigid outer element or shell 12 and a substantially flexible inner element or liner 14 which is at least partially housed inside the outer element 12.

In particular, in the example shown in FIG. 1 the sports footwear 10 is a ski boot, but it is evident that this example is not to be taken as limiting. The invention can also be incorporated into other kinds of footwear, particularly sports footwear such as snowboard boots, roller skates, ice skates and so on.

The outer shell 12 comprises a lower part 12*a* suitable for receiving the user's foot and an upper part of cuff 12*b* suitable for receiving the ankle and the lower part of the user's calf, an opening 12*c* for insertion of the user's foot being provided at the upper edge of the upper part 12*b*.

Correspondingly, the inner liner 14 comprises a lower part suitable for receiving the user's foot—not visible in FIG. 1 as it is completely inside the outer shell 12—and an upper part or cuff 14*b* suitable for receiving the ankle and the lower part of the user's calf, the upper part 14*b* projecting at least in sections from the upper edge of the upper part 12*b* of the outer shell 12. An opening 14*c* for insertion of the user's foot is correspondingly provided at the upper edge of the upper part 14*b* of the inner liner.

At least the outer shell 12—and possibly also the inner liner 14—has a longitudinal opening 16 extending over the lower part 12*a* and the upper part 12*b* of the outer shell up to the upper edge of the outer shell.

Thanks to the opening 16, the space defined inside the footwear 10 can be varied in order to allow insertion of the user's foot inside the footwear and removal thereof from the footwear and in order to allow to adapt the space to the morphological features of the user's foot.

To this aim, the footwear 10 has a plurality of adjustable tightening members 18 arranged along the opening 16.

In particular, the footwear 10 has a tightening device 1 according to the invention which is arranged substantially at the upper edge of the upper part 12*b* of the outer shell 12 and is intended for adjusting the width of the opening 12*c*,14*c* for insertion of the user's foot.

The tightening device 1 comprises a strap element 3 arranged transversely above the opening 16 of the outer shell 12 and means for tensioning the strap element 3.

In the example shown in FIG. 1, a first end of the strap element 3 is connected, by means of a ring 5, to a buckle 7 and the opposite end of the strap element (not visible in FIG. 1) is connected, by means of a corresponding ring, to a band 9 made of substantially inextensible material.

This configuration is not to be intended as limiting. For instance, the strap element 3 could also be slidably mounted on a conventional hook-and-loop fastener strap.

The band 9 is guided around the upper edge of the upper part 12*b* of the outer shell 12 and is inserted into the buckle 7 so as to form a closed ring around the opening 12*c*,14*c* for insertion of the user's foot. By adjusting the position of the buckle 7 along the band 9 it is possible to reduce or increase the width of the closed ring while simultaneously narrowing the opening 12*c*,14*c* for insertion of the user's foot or enabling widening thereof. At the same time, by adjusting the position of the buckle 7 along the band 9, it is possible to tension or loosen the strap element 3, thus increasing or reducing the pressure that the strap element 3 exerts onto the footwear 10 at the opening 12*c*,14*c* for insertion of the user's foot.

For this purpose, the buckle 7 can comprise a lever element 7*a* that can move from an open position, in which the band 9 is free to slide relative to the buckle 7, to a closed position, in which the buckle 7 engages the band 9, which is locked relative to the buckle.

Figure 2:
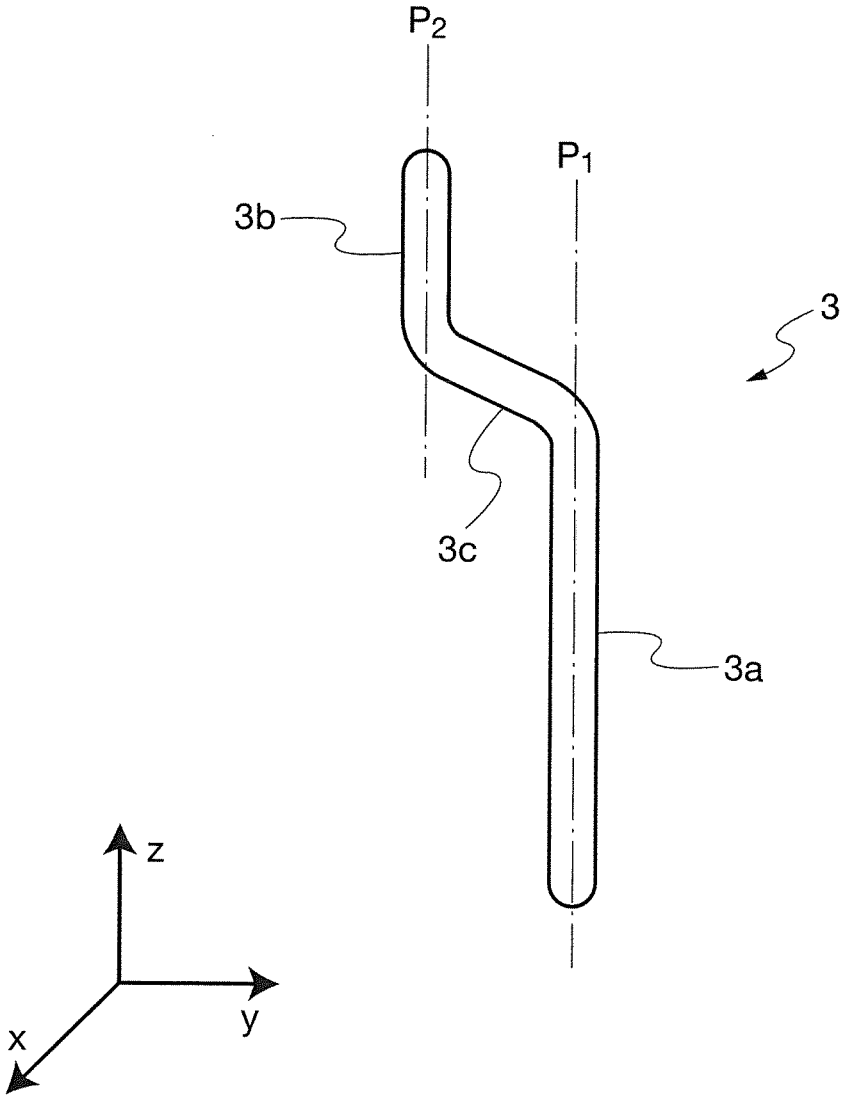
FIG. 2 schematically shows a cross-section of the strap element of the tightening device of FIG. 1.

According to the invention, and as better visible in FIG. 2, the strap element 3 of the tightening device 1 according to the invention comprises a first section 3*a* and a second section 3*b* extending parallel to each other in a first direction (x) and arranged adjacent to each other along a second direction (z) substantially perpendicular to the first direction, the first section 3*a* lying in a first plane P1 and the second section 3*b* lying in a second plane P2 offset relative to the first plane in a third direction (y) substantially perpendicular to the first and second directions.

It has to be noted that the sections 3*a* and 3*b* can be arranged mutually adjacent and side-by-side along the second direction (z), but also adjacent to and a certain distance from each other along the second direction (z).

Thanks to the configuration of the strap element 3 of the tightening device 1 according to the invention, the tightening device can be arranged so that the first section—or lower section—3*a* of the strap element 3 overlaps the upper part 12*b* of the outer shell 12 in the proximity of its upper edge, and the second section—or upper section—3*b* of the strap element 3 overlaps the upper part 14*b* of the inner liner 14, at least at those sections where the liner 14 with its upper part projects from the outer shell 12.

In this way, when the tightening device 1 is tightened around the opening 12*c*,14*c* for insertion of the user's foot into the footwear 10, the first section—or lower section—3*a* of the strap element 3 presses directly onto the upper part 12*b* of the outer shell 12 and the second section—or upper section—3*b* of the strap element 3 presses directly onto the upper part 14*b* of the inner liner 14. Consequently the pressure exerted by the strap element 3 is uniformly distributed and the user's comfort is remarkably improved.

Advantageously, according to the invention, the first and second sections 3*a*,3*b* of the strap element 3 are connected to each other by means of a connecting section 3*c*, so that the strap element 3 has a substantially continuous surface. Thanks to this provision, the correct positioning of the strap element 3 can be maintained more easily and stably, also when the footwear 10 and its tightening device 1 undergo high stresses during sports practices. Accordingly, strap element 3 has a step shape in the cross section taken vertically through the strap element 3 such that the connecting section 3*c* constantly extends transversely between the parallel first and second section 3*a*,3*b* thereby forming the step shape and maintaining the offset. Further, the radius of curvature of the second section 3*b* is less than the radius of curvature of the first section 3*c*.

Moreover, the connecting section 3*c* is designed so that the first and second sections are mutually offset along the third direction and it is made of a sufficiently rigid material to keep the first and second sections mutually offset along the third direction even during sports practices.

As visible in FIG. 1, preferably the first and second sections 3*a*,3*b* offset relative to each other do not extend over the whole length of the strap element 3, but only in the area where the inner liner 14 projects upwardly from the outer shell 12. The first and second sections 3*a*,3*b* are therefore connected to each other by means of further connecting sections 3*d* (of which only one is visible in FIG. 1) at the opposite ends of the strap element 3.

It is evident that the strap element 3 will be made of elastic material so as to be capable of being tensioned by means of the band 9 and of the buckle 7 and thus applying pressure onto the outer shell 12 and onto the inner liner 14, while at the same time it will have to be rigid enough to maintain the desired configuration, with the first and second sections 3*a*,3*b* lying in mutually offset planes.

Strap elements made of fabrics of the kind commonly used in prior art cannot therefore be used for the tightening device according to the invention.

Preferably, the tightening device has a strap element 3 made of plastic material, more preferably it is made of injected plastic material.

The strap element 3 can have homogeneous features over its entire extension.

However, in a preferred embodiment of the invention, the strap element 3 is made in such a way that the first section 3*a* and the second section 3*b* have different features and in particular different rigidities. Such different rigidities can be obtained for instance by using two different materials for making the two sections. For example, in the case where the strap element is made of injected plastic material, it is possible to inject two different plastic materials into the mold, at the two aforementioned sections. As an alternative, such different rigidities can be obtained, for instance, by using the same material but with different densities for making the two sections.

It is clear from what has been described above that the tightening device according to the invention achieves the object set forth above.

It is further evident that the detailed description provided herein of an embodiment of the tightening device has been given solely by way of example and that several modifications and variations are possible within variants are possible without departing from the scope of the invention as defined in the appended claims. For instance, the structure of the tightening device 1, and in particular of the means for tensioning the strap element 3, is not limited to the one described above with reference to FIG. 1.

The tightening device 1 might not extend over the entire opening 12*c*,14*c* for insertion of the user's foot, but only over part of it, at the opening 16 of the outer shell 12. In addition, the means for tensioning the strap element 3, instead of consisting of band 9 and buckle 7, might consist of elements of different kind, such as for instance a toothed rack that is attached to the outer shell 12 and a hook that is connected at one end to the strap element 3 and capable of engaging into one of the teeth of the aforesaid toothed rack.

We claim:

1. Footwear, comprising: a shell forming a boot and a shell liner lining interior surfaces of the shell, the shell and shell liner each having upper edges defining an upper opening for insertion of a foot of a user into the footwear, at least a section of the upper edge of the shell liner projecting above the upper edge of the shell;

and a tightening device connected to the shell and comprising a strap element and tensioning means for tensioning the strap element relative to the shell and shell liner, wherein the strap element of the tightening device comprises a first section and a second section extending parallel to each other in a first direction and arranged adjacent to each other along a second direction substantially perpendicular to the first direction, the first section lying in a first plane and the second section lying in a second plane offset relative to the first plane in a third direction substantially perpendicular to the first and second directions, the first section and the second section of the strap element being mutually connected by a connecting section, wherein the first section, the second section, and the connecting section of the strap element are formed as an integral one-piece strap with the connecting section extending radially outward relative to the upper opening from a lower edge of the second section to an upper edge of the first section such that the strap element has a substantially continuous surface and such that, when tensioned, the first element of the strap element engages an outer surface of the shell adjacent the upper edge of the shell, the connecting section of the strap element extends over the upper edge of the shell, and the second section of the strap element engages an outer surface of the shell liner adjacent the upper edge of the shell liner, and wherein the connecting section, due to its rigidity, keeps the first and second sections mutually offset along the third direction such that the second section is maintained radially inward of the first section relative to the upper opening.

2. The footwear according to claim 1, wherein the first and second sections are arranged mutually adjacent and side-by-side along the second direction.

3. The footwear according to claim 1, wherein the first and second sections are arranged mutually adjacent and at a distance from each other along the second direction.

4. The footwear according to claim 1, wherein at opposite ends of the strap element the first section and the second section of the strap element are connected to each other by means of further connecting sections.

5. The footwear according to claim 1, wherein the strap element is made of a plastic material.

6. The footwear according to claim 1, wherein the first section and the second section of the strap element have different rigidities.

7. The footwear according to claim 1, wherein the first section and the second section of the strap element are made of different materials.

8. The footwear according to claim 1, wherein the first section and the second section of the strap element are made with different densities.

9. The footwear according to claim 1, wherein the tensioning means includes a buckle and a band, and wherein the strap element is connected at its one end to the buckle and at its other end to the band, the band passing inside the buckle and the buckle comprising a lever element that is capable of passing from an open position, in which the band can freely slide relative to the buckle, to a closed position, in which the buckle engages the band, which is locked relative to the buckle.

10. A footwear comprising an outer element comprising a lower part and an upper part, and an inner element at least partially housed inside the outer element and comprising a lower part and an upper part, an upper opening for the insertion of a foot of a user into the footwear being provided on an upper edge of the upper part of the outer element and on an upper edge of the upper part of the inner element, wherein the upper part of the inner element projects at least in sections from the upper edge of the upper part of the outer element, wherein a longitudinal opening extends over the outer element, wherein the footwear comprises a tightening device comprising a strap element and tensioning means for tensioning the strap element, wherein the strap element of the tightening device comprises a first section and a second section extending parallel to each other in a first direction and arranged adjacent to each other along a second direction substantially perpendicular to the first direction, the first section lying in a first plane and the second section lying in a second plane offset relative to the first plane in a third direction substantially perpendicular to the first and second directions, the first section and the second section of the strap element being mutually connected by a connecting section, wherein the first section, the second section, and the connecting section of the strap element are formed as an integral one-piece strap with the connecting section extending radially outward from a lower edge of the second section to an upper edge of the first section such that the strap element has a substantially continuous surface and such that, when tensioned, the first element of the strap element engages an outer surface of the outer element adjacent the upper edge of the outer element, the connecting section of the strap element extends over the upper edge of the outer element, and the second section of the strap element engages an outer surface of the inner element adjacent the upper edge of the inner element, wherein the connecting section, due to its rigidity, keeps the first and second sections mutually offset along the third direction such that the second section is maintained radially inward of the first section relative to the upper opening.

11. The footwear according to claim 10, wherein the tightening device is arranged so that the first section of the strap element overlaps the outer element of the footwear in the proximity of the upper edge of the upper part of the outer element, and the second section of the strap element overlaps the inner element of the footwear, at least at those sections where it projects from the upper edge of the upper part of the outer element.

12. The footwear according to claim 10, wherein the tightening device is arranged so that the strap element extends transversely over the longitudinal opening of the outer element.

13. The footwear according to claim 5, wherein the strap element is made of an injected plastic material.

14. The footwear according to claim 1, wherein the strap element has a step shape in cross-section taken vertically through the strap element such that the connecting section constantly extends transversely between the parallel first and second sections of the strap element thereby forming the step shape and maintaining the offset.

15. The footwear according to claim 1, wherein a radius of curvature of the second section is less than a radius of curvature of the first section.

16. The footwear according to claim 10, wherein the strap element has a step shape in cross-section taken vertically through the strap element such that the connecting section constantly extends transversely between the parallel first and second sections of the strap element thereby forming the step shape and maintaining the offset.

17. The footwear according to claim 11, wherein a radius of curvature of the first section of the strap element where the first section overlaps the outer element of the footwear is greater than a radius of curvature of the second section of the strap element where the second section overlaps the inner element of the footwear.

18. Footwear, comprising:

a shell forming a boot and a shell liner lining interior surfaces of the shell, the shell and shell liner each having upper edges defining an upper opening for insertion of a foot of a user into the footwear, at least a section of the upper edge of the shell liner projecting above the upper edge of the shell;

and a tightening device connected to an outer surface of the shell and comprising a strap element and tensioning means for tensioning the strap element against the shell and shell liner;

wherein the strap element of the tightening device comprises a first section, a second section, and a connecting section which are formed as an integral one-piece strap with the connecting section extending radially outward relative to the upper opening from a lower edge of the second section to an upper edge of the first section such that the strap element has a substantially continuous surface and such that, when the strap element is tensioned, the first element engages and is tightened against an outer surface of the shell adjacent the upper edge of the shell, the connecting section extends over the upper edge of the shell, and the second section engages and is tightened against an outer surface of the shell liner adjacent the upper edge of the shell liner; and wherein the connecting section, due to its rigidity, maintains the second section radially inward of the first section relative to the upper opening and such that the strap element is provided with a step shape in cross-section taken vertically through the strap element in which the connecting section extends transversely in a fixed position between the first and second sections of the strap element thereby forming the step shape.

* * * * *